US007552584B2

(12) United States Patent
Wang et al.

(10) Patent No.: US 7,552,584 B2
(45) Date of Patent: Jun. 30, 2009

(54) COMMON ENGINE AND EXHAUST TREATMENT FUEL SYSTEM

(75) Inventors: Lifeng Wang, Dunlap, IL (US); Rui Zhang, Peoria, IL (US); John D. Gierszewski, Creve Coeur, IL (US); Curtis J. Graham, Peoria, IL (US); Andrew C. Heebink, Chillicothe, IL (US); Jack A. Merchant, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 64 days.

(21) Appl. No.: 11/707,861

(22) Filed: Feb. 20, 2007

(65) Prior Publication Data

US 2007/0227126 A1 Oct. 4, 2007

Related U.S. Application Data

(60) Provisional application No. 60/787,689, filed on Mar. 31, 2006.

(51) Int. Cl.
*F01N 3/00* (2006.01)

(52) U.S. Cl. ..... 60/286; 60/311; 123/300

(58) Field of Classification Search ..... 123/304, 123/299, 300; 60/285, 286, 274, 311
See application file for complete search history.

(56) References Cited

U.S. PATENT DOCUMENTS

| | | | | |
|---|---|---|---|---|
| 2,700,301 | A | 1/1955 | Thomsen | |
| 4,404,796 | A * | 9/1983 | Wade | 60/274 |
| 4,617,793 | A | 10/1986 | Suzuki et al. | |
| 4,944,153 | A * | 7/1990 | Goerlich et al. | 60/303 |
| 5,921,883 | A | 7/1999 | Bellinger | |
| 6,666,020 | B2 * | 12/2003 | Tonetti et al. | 60/286 |
| 6,684,849 | B2 * | 2/2004 | zur Loye et al. | 123/295 |
| 6,694,727 | B1 | 2/2004 | Crawley et al. | |
| 6,735,941 | B2 | 5/2004 | Saito et al. | |
| 6,766,828 | B2 | 7/2004 | Takada et al. | |
| 6,895,745 | B2 * | 5/2005 | Roby | 60/280 |
| 6,953,492 | B2 | 10/2005 | Callahan | |
| 6,989,045 | B2 | 1/2006 | Bailey et al. | |
| 2001/0036413 | A1 | 11/2001 | McFadden et al. | |
| 2003/0140621 | A1 * | 7/2003 | Khair et al. | 60/286 |
| 2004/0103653 | A1 * | 6/2004 | van Nieuwstadt et al. | 60/286 |
| 2004/0208754 | A1 | 10/2004 | McFadden et al. | |
| 2005/0000209 | A1 * | 1/2005 | Takahashi et al. | 60/286 |

(Continued)

FOREIGN PATENT DOCUMENTS

EP 1 510 679 A2 3/2005

(Continued)

*Primary Examiner*—Stephen K Cronin
*Assistant Examiner*—Arnold Castro
(74) *Attorney, Agent, or Firm*—Finnegan, Henderson, Farabow, Garrett & Dunner

(57) ABSTRACT

A fuel system for an engine is disclosed. The fuel system has a common source of pressurized fuel, at least one injection device, an exhaust treatment device, and a regeneration device. The at least one injection device is configured to inject fuel from the common source into a combustion chamber of the engine. The exhaust treatment device is configured to remove particulate matter from an exhaust flow of the engine. The regeneration device is configured to inject fuel from the common source into at least one of the exhaust treatment device and the exhaust flow.

19 Claims, 2 Drawing Sheets

U.S. PATENT DOCUMENTS

| | | | | |
|---|---|---|---|---|
| 2005/0247048 | A1 | 11/2005 | Schaller et al. | |
| 2006/0248881 | A1 | 11/2006 | Yokota | |
| 2006/0283177 | A1 | 12/2006 | Carroll, III et al. | |
| 2007/0130918 | A1 * | 6/2007 | Cueman et al. | 60/286 |
| 2007/0220865 | A1 * | 9/2007 | Cunningham et al. | 60/286 |

FOREIGN PATENT DOCUMENTS

| | | | |
|---|---|---|---|
| EP | 1 746 265 | A1 | 1/2007 |
| GB | 2 357 047 | A | 6/2001 |
| JP | 54025379 | | 2/1979 |
| WO | WO 01/73300 | | 10/2001 |
| WO | WO 2005/071235 | A1 | 8/2005 |

* cited by examiner

COMMON ENGINE AND EXHAUST TREATMENT FUEL SYSTEM

RELATED APPLICATIONS

This application is based upon and claims the benefit of priority from U.S. Provisional Application No. 60/787,689, entitled "COMMON ENGINE AND EXHAUST TREATMENT FUEL SYSTEM", filed Mar. 31, 2006, which is incorporated herein by reference.

TECHNICAL FIELD

The present disclosure is directed to a fuel system and, more particularly, to a fuel system that is common to an engine and an exhaust treatment device.

BACKGROUND

Engines, including diesel engines, gasoline engines, gaseous fuel power engines, and other engines known in the art, may exhaust a complex mixture of air pollutants. These air pollutants may include solid material known as particulate matter or soot. Due to increased attention on the environment, exhaust emission standards have become more stringent and the amount of particulate matter emitted from an engine may be regulated depending on the type of engine, size of engine, and/or class of engine.

One method implemented by engine manufacturers to comply with the regulation of particulate matter exhausted to the environment has been to remove the particulate matter from the exhaust flow of an engine with a device called a particulate trap. A particulate trap is a filter designed to trap particulate matter and consists of a wire mesh or ceramic honeycomb medium. However, the use of the particulate trap for extended periods of time may cause the particulate matter to build up in the medium, thereby reducing the functionality of the filter and subsequently engine performance.

One method of improving the performance of the particulate trap may be to implement regeneration. For example, U.S. Pat. No. 6,694,727 (the '727 patent) issued to Crawley et al. on Feb. 24, 2004, describes an exhaust processor having a soot filter and filter regenerator. The filter regenerator includes a fuel powered burner that supplies fuel to the soot filter to regenerate the soot filter. The fuel powered burner includes a burner, a fuel supply, and a fuel valve. The fuel valve is interposed between the fuel supply and the burner to control the flow rate of fuel from the supply to the burner.

Although the fuel burner of the '727 patent may sufficiently regenerate the soot filter, it may be expensive, and unstable. In particular, because the fuel burner includes its own dedicated fuel supply, the additional components of the fuel supply may increase the cost of the power system package (e.g., the engine and exhaust processor). In addition, because no means for stabilizing the fuel flow from the supply to the burner is provided within the exhaust processor of the '727 patent, fluctuations in fuel pressure and/or flow rate could induce volatility in the regeneration process.

The fuel system of the present disclosure solves one or more of the problems set forth above.

SUMMARY OF THE INVENTION

One aspect of the present disclosure is directed to a fuel system. The fuel system includes a common source of pressurized fuel, at least one injection device, an exhaust treatment device, and a regeneration device. The at least one injection device is configured to inject fuel from the common source into a combustion chamber of the engine. The exhaust treatment device is configured to remove particulate matter from an exhaust flow of the engine. The regeneration device is configured to inject fuel from the common source into at least one of the exhaust treatment device and the exhaust flow.

Another aspect of the present disclosure is directed to a method of controlling a fuel system. The method includes operating a common source to pressurize fuel and directing the pressurized fuel from the common source to a combustion chamber of an engine. The method also includes directing pressurized fuel from the common source to a particulate regeneration device.

DETAILED DESCRIPTION

Figure 1:
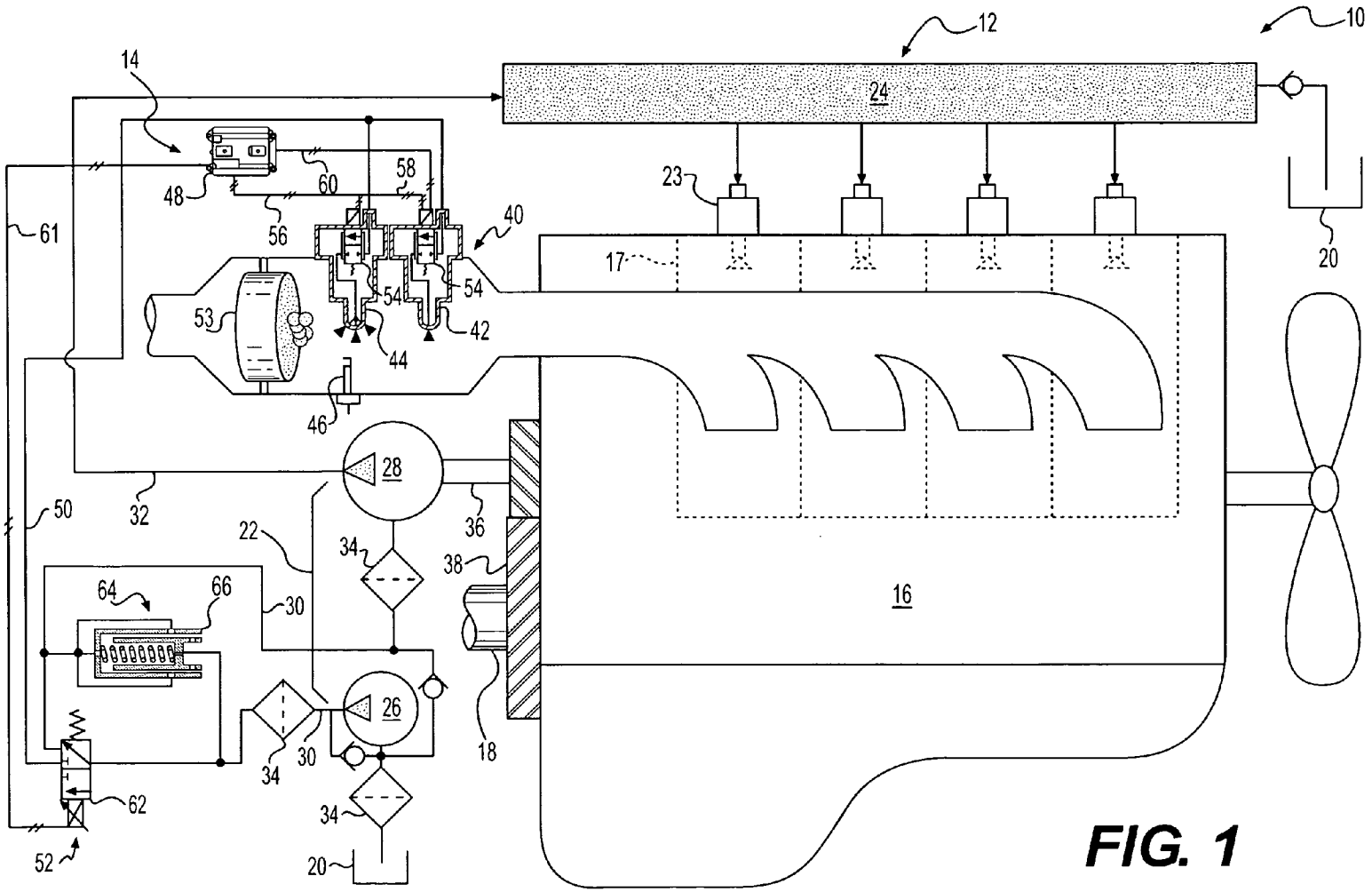
FIG. 1 is a schematic and diagrammatic illustration of an exemplary disclosed power system.

FIG. 1 illustrates a power system 10 having a common rail injection system 12 and an particulate regeneration system 14. For the purposes of this disclosure, power system 10 is depicted and described as a four-stroke diesel engine. One skilled in the art will recognize, however, that power system 10 may embody any other type of internal combustion engine such as, for example, a gasoline or gaseous fuel-powered engine. Power system 10 may include an engine block 16 that at least partially defines a plurality of combustion chambers 17. In the illustrated embodiment, power system 10 includes four combustion chambers 17. However, it is contemplated that power system 10 may include a greater or lesser number of combustion chambers 17 and that combustion chambers 17 may be disposed in an "in-line" configuration, a "V" configuration, or any other suitable configuration.

As also shown in FIG. 1, power system 10 may include a crankshaft 18 that is rotatably disposed within engine block 16. A connecting rod (not shown) associated with each combustion chamber 17 may connect a piston (not shown) to crankshaft 18 so that a sliding motion of each piston within the respective combustion chamber 17 results in a rotation of crankshaft 18. Similarly, a rotation of crankshaft 18 may result in a sliding motion of the pistons.

Common rail injection system 12 may include components that cooperate to deliver injections of pressurized fuel into each combustion chamber 17. Specifically, common rail injection system 12 may include a tank 20 configured to hold a supply of fuel, and a fuel pumping arrangement 22 configured to pressurize the fuel and direct the pressurized fuel to a plurality of fuel injectors 23 by way of a common rail 24.

Fuel pumping arrangement 22 may include one or more pumping devices that function to increase the pressure of the fuel and direct one or more pressurized streams of fuel to common rail 24. In one example, fuel pumping arrangement 22 includes a low pressure source 26 and a high pressure source 28 disposed in series and fluidly connected by way of a fuel line 30. Low pressure source 26 may embody a transfer pump configured to provide low pressure feed to high pressure source 28. High pressure source 28 may be configured to receive the low pressure feed and increase the pressure of the fuel to the range of about 30-300 MPa. High pressure source 28 may be connected to common rail 24 by way of a fuel line 32. One or more filtering elements 34, such as a water separator, a primary filter, and a secondary filter, may be disposed within fuel line 30 in series relation to remove debris and/or water from the fuel pressurized by fuel pumping arrangement 22.

One or both of low and high pressure sources 26, 28 may be operably connected to power system 10 and driven by crankshaft 18. Low and/or high pressure sources 26, 28 may be connected to crankshaft 18 in any manner readily apparent to one skilled in the art where a rotation of crankshaft 18 will result in a corresponding driving rotation of a pump shaft. For example, a pump driveshaft 36 of high pressure source 28 is shown in FIG. 1 as being connected to crankshaft 18 through a gear train 38. It is contemplated, however, that one or both of low and high pressure sources 26, 28 may alternatively be driven electrically, hydraulically, pneumatically, or in any other appropriate manner.

Particulate regeneration system 14 may be associated with an exhaust treatment device 40. In particular, as exhaust from power system 10 flows through exhaust treatment device 40, particulate matter may be removed from the exhaust flow by wire mesh or ceramic honeycomb filtration media 53. Over time, the particulate matter may build up in filtration media 53 and, if left unchecked, the particulate matter buildup could be significant enough to restrict, or even block the flow of exhaust through exhaust treatment device 40, allowing for backpressure within power system 10 to increase. An increase in the backpressure of power system 10 could reduce the system's ability to draw in fresh air, resulting in decreased performance, increased exhaust temperatures, and poor fuel consumption.

Particulate regeneration system 14 may include components that cooperate to periodically reduce the buildup of particulate matter within exhaust treatment device 40. These components may include, among other things, a pilot injector 42, a main injector 44, a spark plug 46, and an associated controller 48. It is contemplated that particulate regeneration system 14 may include additional or different components such as, for example, an air injection system, a pressure sensor, a temperature sensor, a flow sensor, a flow blocking device, and other components known in the art.

Pilot and main injectors 42, 44 may be disposed within a housing of exhaust treatment device 40 and connected to fuel line 30 by way of a fluid passageway 50 and a main control valve 52. Each of pilot and main injectors 42, 44 may be operable to inject an amount of pressurized fuel into exhaust treatment device 40 at predetermined timings, fuel pressures, and fuel flow rates. The timing of fuel injection into exhaust treatment device 40 may be synchronized with sensory input received from a temperature sensor (not shown), one or more pressure sensors (not shown), a timer (not shown), or any other similar sensory devices such that the injections of fuel substantially correspond with a buildup of particulate matter within exhaust treatment device 40. For example, fuel may be injected as a pressure of the exhaust flowing through exhaust treatment device 40 exceeds a predetermined pressure level or a pressure drop across filtration media 53 of exhaust treatment device 40 exceeds a predetermined differential value. Alternatively or additionally, fuel may be injected as the temperature of the exhaust flowing through exhaust treatment device 40 deviates from a desired temperature by a predetermined value. It is further contemplated that fuel may also be injected on a set periodic basis, in addition to or regardless of pressure or temperature conditions, if desired.

Each of pilot and main injectors 42, 44 may include an electronically controlled proportional valve element 54 that is solenoid movable against a spring bias in response to a commanded flow rate. Valve element 54 may be movable between a first position at which pressurized fuel may spray into exhaust treatment device 40, and a second position at which fuel may be blocked from exhaust treatment device 40. Valve element 54 may be moved to any position between the first and second positions to vary the rate of fuel flow into exhaust treatment device 40. Valve elements 54 may be connected to controller 48 in series relation via a first, second, and third communication line 56, 58, 60 to receive an electronic signal indicative of the commanded flow rates.

Similar to pilot and main injectors 42, 44, main control valve 52 may also include an electronically controlled valve element 62 that is solenoid movable against a spring bias in response to a command. Valve element 62 may be movable from a first position at which pressurized fuel from low pressure source 26 may be directed through main control valve 52 to only high pressure source 28 and common rail 24, against a spring bias to a second position at which fuel may be directed from low pressure source 28 through main control valve 52 to only particulate regeneration system 14. Valve element 62 may be connected to controller 48 via a communication line 61 to receive electronic signals indicative of which of the first and second positions is desired. It is contemplated that the spring bias may alternatively urge valve element 62 toward the second position and electronically movable toward the first position, if desired.

As valve element 62 is moved to the second position and fuel flows through main control valve 52 to higher pressure source 28 and common rail 24 is blocked, the pressure of the fuel flowing through main control valve 52 to exhaust treatment device 40 may rise. In particular, as valve element 62 moves to fluidly connect fuel pumping arrangement 22 with exhaust treatment device 40, the flow rate of fuel demanded from low pressure source 26 may drop. The reduced demand for fuel combined with a substantially continuous supply of fuel may essentially "dead head" low pressure source 26 causing the pressure of the fuel worked by low pressure source 26 to increase from a first pressure level of about 80 psi to a second pressure level that is about four times the first pressure level or about 300 psi. As the pressure of the fuel nears about 300 psi, a bypass circuit 64 may allow the pressurized fuel to circumvent main control valve 52 and flow to high pressure source 28 and common rail 24. Bypass circuit 64 may include a pressure regulating valve 66 that facilitates this process, while dampening associated pressure fluctuations. It should be noted that, although pressure regulating valve 66 is illustrated in FIG. 1 as being located upstream of main control valve 52, it is contemplated that pressure regulating valve 66 may alternatively be located downstream of main control valve 52, if desired.

Figure 2:
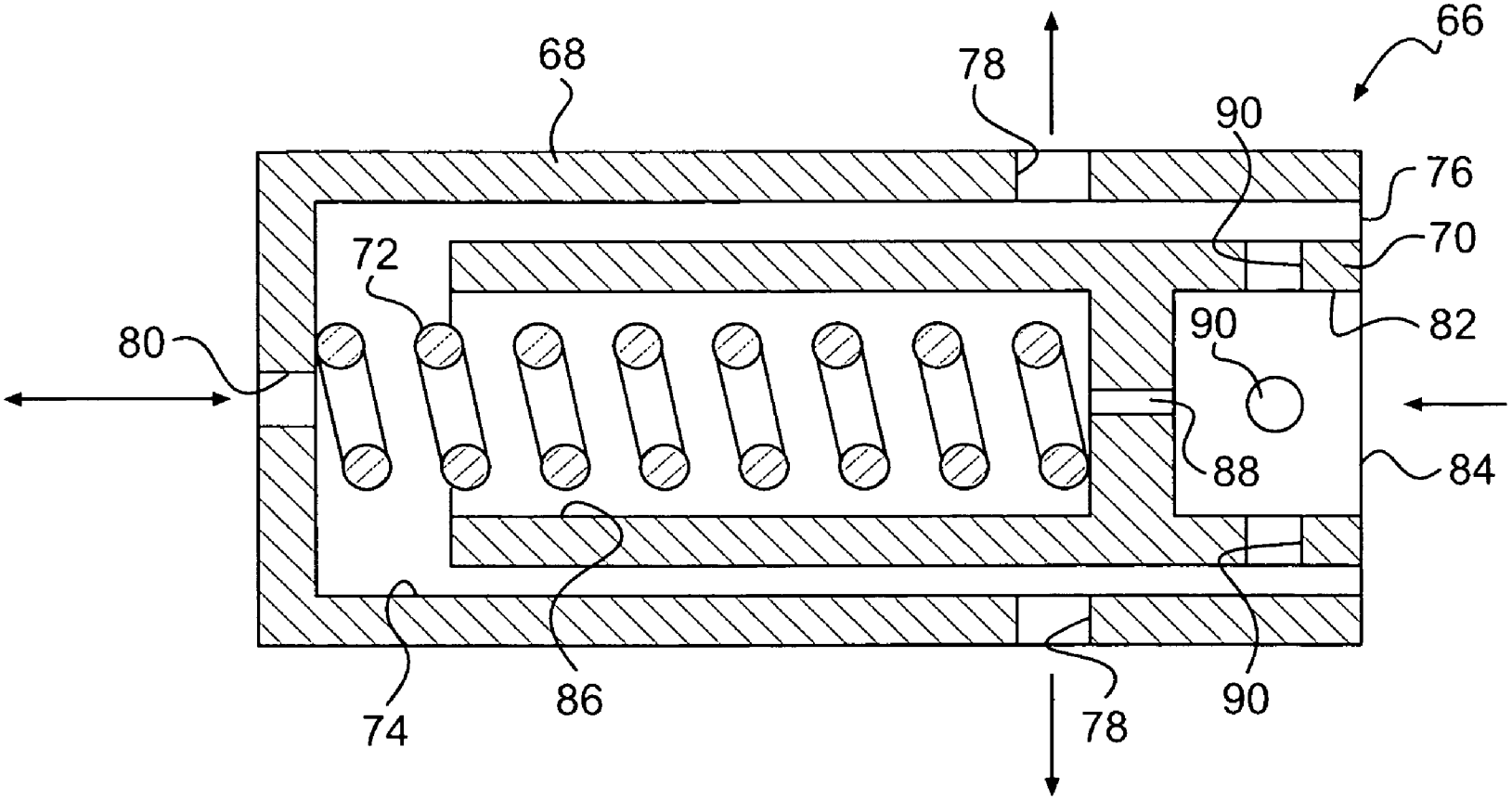
FIG. 2 is a schematic illustration of a pressure regulating valve for use with the power system of FIG. 1.

As illustrated in FIG. 2, pressure regulating valve 66 may include a housing 68, a spool element 70 disposed within housing 68, and a spring element 72. Housing 68 may include a central bore 74, an inlet 76, a radially arranged outlet(s) 78, and a restrictive orifice 80 disposed within an end of housing 68 opposite inlet 76. Inlet 76 may be located to allow pressurized fuel from upstream of main control valve 52 to act against spool element 70 and move spool element 70 between a first or flow blocking position toward a second or flow passing position. When in the flow passing position, fuel may be directed to common rail 24 via outlet(s) 78.

Spool element 70 may be substantially cylindrical to slidingly engage interior walls of central bore 74. Spool element 70 may include a first central bore 82 forming an inlet 84, a second central bore 86 housing spring element 72, an axially aligned and centrally located restrictive orifice 88 connecting first and second central bores 82, 86, and a radially arranged outlet(s) 90. As spool element 70 is moved from the first position to the second position, outlet(s) 90 may align and fluidly communicate with outlet(s) 78 allowing pressurized fuel to flow from first central bore 82 through outlet(s) 78 to high pressure source 28. Some amount of fuel, regardless of the position of spool element 70, may always flow through pressure regulating valve 66 by way of restrictive orifices 80 and 88. The restriction of orifice 88 may be less than the restriction of orifice 80 such that a low pressure region within second central bore 86 may be generated.

The bias of spring element 72 may regulate, at least in part, the pressure of the fuel supplied to both exhaust treatment device 40 and to high pressure source 28. In particular, after spool element 70 has moved to communicate pressurized fuel from low pressure source 26 with exhaust treatment device 40, the bias of spring element 72 may prevent substantial fuel flow (e.g., flow via outlet(s) 78 of pressure regulating valve 66) to high pressure source 28 and common rail 24, until the pressure of the fuel flowing through main control valve 52 has risen from about 80 psi to the predetermined level of about 300 psi. In this manner, pressure regulating valve 66 may regulate the pressure of the fuel supplied to exhaust treatment device 40. Outlet(s) 78 may be sized such that, although the pressure upstream of pressure regulating valve 66 may rise to 300 psi during a regeneration event, a pressure drop across pressure regulating valve 66 provides fuel having a pressure near 80 psi to a point downstream of pressure regulating valve 66. In this manner, pressure regulating valve 66 may simultaneously regulate the pressure of the fuel supplied to high pressure source 28 and subsequently common rail 24.

One or more pressure relief circuits 90 (referring to FIG. 1) may be disposed upstream and/or downstream of pressure regulating valve 66 to allow fuel having a pressure greater than a predetermined pressure to return to the inlet of low pressure source 26. In this manner, components of power system 10 may be protected from excessive pressure spikes. In addition, by returning this fluid to an intake of low pressure source 26 rather than to tank 20, less fuel may flow through the filtering element 34 located between tank 20 and low pressure source 26. The reduced flow of fuel through filtering element 34 may prolong the component life of filtering element 34.

Spark plug 46 may facilitate ignition of fuel sprayed from pilot and main injectors 42, 44 into exhaust treatment device 40 during a regeneration event. Specifically, during a regeneration event, the temperature of the exhaust exiting power system 10 may be too low to cause auto-ignition of the particulate matter trapped within exhaust treatment device 40 or of the fuel sprayed from pilot and main injectors 42, 44. To initiate combustion of the fuel and, subsequently, the trapped particulate matter, a small quantity of fuel from pilot injector 42 may be sprayed or otherwise injected toward spark plug 46 to create a locally rich atmosphere readily ignitable by spark plug 46. A spark developed across electrodes of spark plug 46 may ignite the locally rich atmosphere creating a flame, which may be jetted or otherwise advanced toward the main injection of fuel from main injector 44. The flame jet propagating from pilot injector 42 may raise the temperature within exhaust treatment device 40 to a level which readily supports efficient ignition of the larger injection of fuel from main injector 44. As the fuel sprayed from main injector 44 ignites, the temperature within exhaust treatment device 40 may continue to rise to a level that causes ignition of the particulate matter trapped within filtration media 53 of exhaust treatment device 40, thereby regenerating exhaust treatment device 40.

In order to accomplish these specific injection events, controller 48 may control operation of pilot and main injectors 42, 44 in response to one or more inputs. In particular, controller 48 may be configured to regulate a fuel injection timing, pressure, and/or amount by directing a predetermined current waveform or sequence of predetermined current waveforms to each of pilot and main injectors 42, 44 via communication lines 56, 58. For the purposes of this disclosure, the combination of current levels directed through communication lines 56, 58 to valve elements 54 that produce the desired injections of fuel during a single regeneration event may be considered a current waveform.

Controller 48 may embody a single microprocessor or multiple microprocessors that include a means for controlling an operation of pilot and main injectors 42, 44. Numerous commercially available microprocessors can be configured to perform the functions of controller 48. It should be appreciated that controller 48 could readily embody a general power system microprocessor capable of controlling numerous different functions of power system 10. Controller 48 may include components required to run an application such as, for example, a memory, a secondary storage device, and a processor, such as a central processing unit or any other means known in the art. Various other known circuits may be associated with controller 48, including power supply circuitry, signal-conditioning circuitry, solenoid driver circuitry, communication circuitry, and other appropriate circuitry.

INDUSTRIAL APPLICABILITY

The fuel system of the present disclosure may be applicable to a variety of power system configurations that include at least an engine and an exhaust treatment device. The disclosed fuel system may cost effectively supply pressurized fuel to the engine and exhaust treatment device in a substantially stable manner, by utilizing a common source of pressurized fuel and a fluctuation-dampening pressure regulator. The operation of power system 10 will now be explained.

Referring to FIG. 1, air and fuel may be drawn into the combustion chambers of power system 10 for subsequent combustion. Specifically, fuel from common rail injection system 12 may be injected into the combustion chambers of power system 10, mixed with the air therein, and combusted by power system 10 to produce a mechanical work output and an exhaust flow of hot gases. The exhaust flow may contain a complex mixture of air pollutants composed of gaseous and solid material, which includes particulate matter. As this particulate laden exhaust flow is directed from the combustion chambers through exhaust treatment device 40, particulate matter may be strained from the exhaust flow by filtration media 53. Over time, the particulate matter may build up in filtration media 53 and, if left unchecked, the buildup could be significant enough to restrict, or even block the flow of exhaust through exhaust treatment device 40. As indicated above, the restriction of exhaust flow from power system 10 may increase the backpressure of power system 10 and reduce the system's ability to draw in fresh air, resulting in decreased performance of power system 10, increased exhaust temperatures, and poor fuel consumption.

To prevent the undesired buildup of particulate matter within exhaust treatment device 40, filtration media 53 may be regenerated. Regeneration may be periodic or based on a triggering condition such as, for example, a lapsed time of engine operation, a pressure differential measured across filtration media 53, a temperature of the exhaust flowing from power system 10, or any other condition known in the art.

Controller 48 may be configured to initiate regeneration. In particular, controller 48 may send a single driver output via communication line 56 to both pilot and main injectors 42, 44 that causes pilot and main injectors 42, 44 to selectively pass fuel into exhaust treatment device 40 at a desired rate. As the fuel from pilot injector 42 sprays into exhaust treatment device 40, a spark from spark plug 46 may ignite the pilot flow of fuel. As the larger flow of fuel from main injector 44 is injected into exhaust treatment device 40, the ignited pilot flow of fuel may ignite the larger flow of fuel. The ignited larger flow of fuel may then raise the temperature of the particulate matter trapped within filtration media 53 to the combustion level of the entrapped particulate matter, burning away the particulate matter and, thereby, regenerating filtration media 53.

The fuel pressure required to regenerate filtering media 53 may be different then the pressure of the fuel injected into combustion chambers 17. In order to provide the different pressure levels with a common source (e.g., low pressure source 26), valve element 62 of main control valve 52 may be electronically moved from the first position against the bias spring element 72 to the second position, thereby blocking the flow of fuel to high pressure source 28 and subsequently common rail 24. Although some fuel may continue to flow through restrictive orifices 80 and 88 of pressure regulating valve 66, the restriction thereof may raise the pressure of the fuel directed through main control valve 52 to about 300 psi. Once this pressure reaches about 300 psi, spool element 70 of pressure regulating valve 66 may move to pass fuel through outlet(s) 78 of pressure regulating valve 66 to high pressure source 88. The pressure drop across pressure regulating valve 66 may provide fuel having a pressure of about 88 psi to high pressure source 88. Once regeneration of filtering element 53 is complete, valve element 62 may be allowed to return to the first position at which the flow of fuel to exhaust treatment device 40 is blocked.

In addition to simultaneously regulating the pressure of fuel directed to both exhaust treatment device 40 and high pressure source 28, pressure regulating valve 66 may also dampen pressure fluctuations within common rail injection system 12 and exhaust treatment device 40. In particular, upon shifting valve element 62 from the first to the second position, the pressure of the fluid within fuel line 30 may rise abruptly. In addition to some energy associated with this abrupt pressure rise being absorbed by the movement of spool element 70 and compression of spring element 72, the location of restrictive orifices 80 and 88 may also provide a form of pressure relief that lowers that magnitude of the pressure spike. Further, as pressurized fuel passes from fuel line 30 through pressure regulating valve 66 to high pressure source 28, because of the restriction of orifices 80 and 88, the abrupt increase in pressure may not be fully realized downstream of pressure regulating valve 66. That is, the pressure of the fluid downstream of pressure regulating valve 66 may rise less abruptly than upstream because of the restriction of orifices 80 and 88. Additionally, upon valve and spool elements 62, 70 returning to their original positions, any resulting low pressure situations created within fuel line 30 may be accommodated with a reverse flow of fuel back through restrictive orifices 80 and 88 of pressure regulating valve 66.

The disclosed fuel system may be simple, inexpensive, and durable. In particular, because a single common source of pressurized fuel may be utilized to power both an engine and a regeneration device, the number of components and associated cost of the integral power system may be reduced. In addition because the disclosed fuel system include provisions for dampening pressure fluctuations, the component life of the system may be prolonged.

It will be apparent to those skilled in the art that various modifications and variations can be made to the fluid control system of the present disclosure without departing from the scope of the disclosure. Other embodiments will be apparent to those skilled in the art from consideration of the specification and practice of the fluid control system disclosed herein. It is intended that the specification and examples be considered as exemplary only, with a true scope of the disclosure being indicated by the following claims and their equivalents.

What is claimed is:

1. A fuel system for an engine, comprising:

a common source of pressurized fuel;

at least one injection device configured to inject fuel from the common source into a combustion chamber of the engine;

an exhaust treatment device configured to remove particulate matter from an exhaust flow of the engine;

a regeneration device configured to inject fuel from the common source into at least one of the exhaust treatment device and the exhaust flow;

a control valve configured to selectively block a stream of pressurized fuel from the common source to the at least one injection device; and a bypass circuit configured to direct fuel from upstream of the control valve to a point upstream of the at least one injection device in response to a change in pressure of the fuel.

2. The fuel system of claim 1, wherein the pressure of the fuel injected by the at least one injection device is different from the pressure of the fuel injected by the regeneration device.

3. The fuel system of claim 1, wherein the bypass circuit is also configured to restrict a flow of fuel to the at least one injection device.

4. The fuel system of claim 3, wherein the control valve includes a valve element solenoid movable between a first position at which pressurized fuel directed through the control valve is only communicated with the at least one injection device, and a second position at which pressurized fuel directed through the control valve is only communicated with the regeneration device.

5. The fuel system of claim 1, wherein the bypass circuit has a pressure regulator configured to regulate the pressure of fuel directed to the regeneration device.

6. The fuel system of claim 5, wherein the pressure regulator is also configured to simultaneously regulate the pressure of the fuel directed to the at least one fuel injection device.

7. The fuel system of claim 6, wherein the regulated pressure of the fuel directed to the regeneration device is about 300 psi and the regulated pressure of the fuel directed to the at least one injection device is about 80 psi.

8. The fuel system of claim 5, wherein the pressure regulator includes:

a housing having a central bore, an inlet, an outlet, and a first restrictive orifice;

a spool element disposed within the housing and being movable between a first position at which fuel may flow from the inlet to the outlet, and a second position at which fuel is blocked from flowing from the inlet to the outlet, the spool valve including:

a central bore that fluidly communicates the inlet with the dampening orifice; and a second restrictive orifice disposed within the central bore of the spool element; and a spring disposed within the housing to bias the spool element toward the second position.

9. The fuel system of claim 8, wherein the flow restriction through the first restrictive orifice is less than the flow restriction through the second orifice.

10. The fuel system of claim 1, wherein the at least one fuel injection device is a common rail type fuel injector.

11. A method of controlling a fuel system, comprising:

operating a common source to pressurize fuel;

directing pressurized fuel from the common source to a combustion chamber of an engine;

directing pressurized fuel from the common source to a particulate regeneration device; and restricting the flow of pressurized fuel to the combustion chamber to simultaneously regulate the pressure of the fuel directed to the particulate regeneration device and the combustion chamber.

12. The method of claim 11, further including selectively blocking a flow of pressurized fuel to the combustion chamber and the particulate regeneration device.

13. The method of claim 11, wherein the regulated pressure of fuel directed to the particulate regeneration device is about four times the regulated pressure of the fuel directed to the combustion chamber.

14. A power system, comprising:

an engine having at least one combustion chamber and being operable produce a power output and a flow of exhaust;

a common source of pressurized fuel;

at least one injection device configured to inject pressurized fuel from the common source into the combustion chamber;

an exhaust treatment device configured to remove particulate matter from the flow of exhaust;

a regeneration device configured to inject pressurized fuel from the common source into the flow of exhaust;

a control valve configured to selectively direct a stream of the pressurized fuel from the common source to the regeneration device and block a flow of fuel to the at least one injection device; and a bypass circuit having a pressure regulator configured to simultaneously regulate the pressure of fuel directed to the regeneration device and the pressure of the fuel directed to the at least one fuel injection device.

15. The power system of claim 14, wherein the regulated pressure of the fuel directed to the regeneration device is about 300 psi and the regulated pressure of the fuel directed to the at least one injection device is about 80 psi.

16. The power system of claim 14, wherein the pressure regulator includes:

a housing having a central bore, an inlet, an outlet, and a first restrictive orifice;

a spool element disposed within the housing and being movable between a first position at which fuel may flow from the inlet to the outlet, and a second position at which fuel is blocked from flowing from the inlet to the outlet, the spool valve including:

a central bore that fluidly communicates the inlet with the dampening orifice; and a second restrictive orifice disposed within the central bore of the spool element; and a spring disposed within the housing to bias the spool element toward the second position.

17. The power system of claim 16, wherein the flow restriction through the first restrictive orifice is less than the flow restriction through the second orifice.

18. The power system of claim 14, wherein the control valve includes a valve element solenoid movable between a first position at which pressurized fuel directed through the control valve is only communicated with the at least one injection device, and a second position at which pressurized fuel directed through the control valve is only communicated with the regeneration device.

19. The power system of claim 14, further including a bypass circuit configured to direct fuel from downstream of the control valve to a point upstream of the common source in response to a pressure of the fuel.

* * * * *